US008226500B2

(12) United States Patent
Yamamoto et al.

(10) Patent No.: US 8,226,500 B2
(45) Date of Patent: Jul. 24, 2012

(54) GOLF CLUB HEAD

(75) Inventors: Akio Yamamoto, Kobe (JP); Seiji Hayase, Kobe (JP)

(73) Assignee: SRI Sports Limited, Kobe (JP)

( * ) Notice: Subject to any disclaimer, the term of this patent is extended or adjusted under 35 U.S.C. 154(b) by 383 days.

(21) Appl. No.: 12/542,088

(22) Filed: Aug. 17, 2009

(65) Prior Publication Data

US 2010/0120556 A1 May 13, 2010

(30) Foreign Application Priority Data

Nov. 13, 2008 (JP) ..... 2008-290447

(51) Int. Cl.
*A63B 53/04* (2006.01)

(52) U.S. Cl. ..... 473/346; 473/332

(58) Field of Classification Search ..... 473/324–350
See application file for complete search history.

(56) References Cited

U.S. PATENT DOCUMENTS

| | | | | |
|---|---|---|---|---|
| 1,538,415 | A * | 5/1925 | Tootle et al. | 473/344 |
| 4,214,754 | A * | 7/1980 | Zebelean | 473/346 |
| 4,432,549 | A * | 2/1984 | Zebelean | 473/346 |
| 4,489,945 | A * | 12/1984 | Kobayashi | 473/346 |
| 5,067,715 | A * | 11/1991 | Schmidt et al. | 473/332 |
| 5,163,682 | A * | 11/1992 | Schmidt et al. | 473/332 |
| 5,180,166 | A * | 1/1993 | Schmidt et al. | 473/332 |
| 5,240,252 | A * | 8/1993 | Schmidt et al. | 473/327 |
| 5,301,945 | A * | 4/1994 | Schmidt et al. | 473/311 |
| 5,318,300 | A * | 6/1994 | Schmidt et al. | 473/305 |
| 5,470,069 | A * | 11/1995 | Schmidt et al. | 473/311 |
| 5,474,296 | A * | 12/1995 | Schmidt et al. | 473/346 |
| 5,697,853 | A * | 12/1997 | Schmidt et al. | 473/328 |
| 5,718,641 | A * | 2/1998 | Lin | 473/224 |
| 5,735,754 | A * | 4/1998 | Antonious | 473/328 |
| 5,908,356 | A * | 6/1999 | Nagamoto | 473/224 |
| 5,941,782 | A * | 8/1999 | Cook | 473/346 |
| 6,315,678 | B1 * | 11/2001 | Teramoto | 473/291 |
| 6,595,871 | B2 * | 7/2003 | Sano | 473/342 |
| 6,783,465 | B2 * | 8/2004 | Matsunaga | 473/329 |
| 7,241,230 | B2 * | 7/2007 | Tsunoda | 473/324 |
| 7,247,103 | B2 * | 7/2007 | Beach et al. | 473/324 |
| 7,250,007 | B2 * | 7/2007 | Lu | 473/329 |
| 7,273,419 | B2 * | 9/2007 | Evans et al. | 473/328 |
| 7,273,423 | B2 * | 9/2007 | Imamoto | 473/332 |
| 7,390,271 | B2 * | 6/2008 | Yamamoto | 473/345 |
| 7,399,237 | B2 * | 7/2008 | Evans et al. | 473/328 |
| 7,500,924 | B2 * | 3/2009 | Yokota | 473/332 |
| 7,572,193 | B2 * | 8/2009 | Yokota | 473/328 |
| 7,731,603 | B2 * | 6/2010 | Beach et al. | 473/335 |

(Continued)

FOREIGN PATENT DOCUMENTS

JP 10-24128 A 1/1998

(Continued)

*Primary Examiner* — Alvin Hunter
(74) *Attorney, Agent, or Firm* — Birch, Stewart, Kolasch & Birch, LLP

(57) ABSTRACT

A head 2 is hollow. The head 2 has a face 4, a crown 6 and a sole 8. A rib 20 is provided on the inner surface of the head. Preferably, the rib 20 has a toe side part **20*t* located on the inner surface of a side 10 of a toe side, a sole disposing part 20*s* located on the inner surface of the sole 8, and a heel side part 20*h* located on the side 10 of a heel side. Preferably, the toe side part 20*t* and the sole disposing part 20*s* are connected with each other. Preferably, the sole disposing part 20*s* and the heel side part 20*h*** are connected with each other.

18 Claims, 10 Drawing Sheets

U.S. PATENT DOCUMENTS

| | | | | |
|---|---|---|---|---|
| 7,749,104 | B2 * | 7/2010 | Brekke et al. | 473/345 |
| 7,758,453 | B2 * | 7/2010 | Horacek et al. | 473/345 |
| 7,798,913 | B2 * | 9/2010 | Noble et al. | 473/324 |
| 7,803,067 | B2 * | 9/2010 | Horacek et al. | 473/345 |
| 7,806,781 | B2 * | 10/2010 | Imamoto | 473/332 |
| 7,828,676 | B2 * | 11/2010 | Wada et al. | 473/346 |
| 8,029,385 | B2 * | 10/2011 | Horacek et al. | 473/345 |
| 8,033,932 | B2 * | 10/2011 | Wada et al. | 473/346 |
| 2002/0022535 | A1 * | 2/2002 | Takeda | 473/346 |
| 2002/0065147 | A1 | 5/2002 | Sano | |
| 2002/0072434 | A1 * | 6/2002 | Yabu | 473/345 |
| 2004/0198532 | A1 * | 10/2004 | Caldwell et al. | 473/345 |
| 2005/0049081 | A1 * | 3/2005 | Boone | 473/346 |
| 2005/0075192 | A1 * | 4/2005 | Han | 473/346 |
| 2006/0073909 | A1 * | 4/2006 | Evans et al. | 473/342 |
| 2006/0172818 | A1 * | 8/2006 | Yamamoto | 473/345 |
| 2008/0132355 | A1 * | 6/2008 | Hoffman et al. | 473/346 |
| 2008/0171615 | A1 * | 7/2008 | Horacek et al. | 473/349 |

FOREIGN PATENT DOCUMENTS

| | | | |
|---|---|---|---|
| JP | 11-347156 | | 12/1999 |
| JP | 2002-113134 | A | 4/2002 |
| JP | 2002-186691 | A | 7/2002 |
| JP | 2003-102877 | A | 4/2003 |
| JP | 2006-204604 | A | 8/2006 |

* cited by examiner

GOLF CLUB HEAD

The present application claims priorities on Japanese Patent Application No. 2008-290447 filed on Nov. 13, 2008. The whole contents of the Japanese Patent Application are hereby incorporated by reference.

BACKGROUND OF THE INVENTION

1. Field of the Invention

The present invention relates to a hollow golf club head.

2. Description of the Related Art

A hollow golf club head has been known. The hollow structure increases a head volume and a moment of inertia. A so-called wood type golf club head is usually hollow. The volume of a hollow part is increased and the thickness of the head is thinned with the increase in size of the head. When the hollow part is great, a hitting sound is loud. Since the vibration of the head is great when the thickness is thin, the hitting sound is loud. The head increased in size causes a loud hitting sound.

A golf club head for obtaining a good hitting sound is disclosed. The invention considering the hitting sound is proposed. Japanese Patent Application Laid-Open No. 2006-204604 (US2006/0172818 A1) discloses a curved rib extending to a heel side edge part from a toe side edge part of a sole. Japanese Patent Application Laid-Open No. 2003-102877 discloses a rib provided on an abdominal part of an out-of-plane secondary bending vibration in a sole part.

SUMMARY OF THE INVENTION

The hollow golf club head with a great volume has a drawback that the hitting sound is excessively lowered. A higher hitting sound is preferable in order to obtain a good hitting sound. Preferably, the hitting sound is further enhanced by the rib provided on the inner surface of the head.

It is an object of the present invention to provide a golf club head capable of improving a hitting sound.

A golf club head according to a first aspect of the present invention includes: a face; a sole; a crown; and a side extending between the crown and the sole. A rib is provided on an inner surface of the head. The rib has a toe side part located on an inner surface of a side of a toe side, a sole disposing part located on an inner surface of a sole, and a heel side part located on a side of a heel side. The toe side part, the sole disposing part and the heel side part are continuously provided. The toe side part, the sole disposing part and the heel side part are linearly continuously provided. The toe side part, the sole disposing part and the heel side part are provided in a line. The head is hollow.

Preferably, a ratio (Wb/Wa) of a face-back direction distance Wb (mm) between a forefront point of the head and a point R1 belonging to the rib to a width Wa (mm) of the head is 0.25 or greater and 0.50 or less in all the points R1.

Preferably, an average height of the rib is 2 mm or greater and 6 mm or less. Preferably, an average width of the rib is 0.5 mm or greater and 1.5 mm or less.

Preferably, a ratio (Wr/Wc) of a length Wr (mm) of the rib to a length Wc (mm) of the head is equal to or greater than 0.80.

Preferably, the rib has further a crown disposing part located on the inner surface of the crown; and the crown disposing part is provided on a heel side and/or a toe side of the rib.

Preferably, a rib length Lc of the crown disposing part on the heel side is equal to or less than 10 mm; and the rib length Lc of the crown disposing part on the toe side is equal to or less than 10 mm.

Preferably, the toe side of the rib terminates at the side, and the heel side of the rib terminates at the crown.

Preferably, a root of the rib has a roundness having a curvature radius rx; and the curvature radius rx is 0.5 mm or greater and 3.0 mm or less.

Preferably, an edge of an upper surface of the rib has a roundness having a curvature radius ry; and the curvature radius ry is equal to or greater than 0.2 mm.

Preferably, a width Wa of the head is 100 mm or greater and 127 mm or less.

Preferably, a length Wc of the head is 100 mm or greater and 127 mm or less.

Preferably, a volume of the head is 400 cc or greater and 470 cc or less.

Preferably, a weight Mh of the head is 175 g or greater and 205 g or less.

Preferably, a weight Mr of the rib is 1.0 g or greater and 5.0 g or less.

Preferably, a ratio (Mr/Mh) of the weight Mr of the rib to the weight Mh of the head is 0.008 or greater and 0.025 or less.

Preferably, a maximum value of a rib height HR of the rib is 3 mm or greater and 10 mm or less.

Preferably, a primary natural frequency obtained by exciting the sole is 3000 Hz or greater and 5000 Hz or less.

Preferably, the number of the ribs is equal to or less than 2.

A golf club head according to a second aspect of the present invention includes a face, a sole, a crown and a side extending between the crown and the sole. The golf club head is hollow. A rib is provided on the inner surface of the golf club head. In the golf club head, a primary natural frequency obtained by exciting the sole is 3000 Hz or greater and 5000 Hz or less.

The present invention can attain the enhancement of the hitting sound.

DESCRIPTION OF THE PREFERRED EMBODIMENTS

Hereinafter, the present invention will be described in detail according to the preferred embodiments with appropriate references to the drawings.

Figure 1:
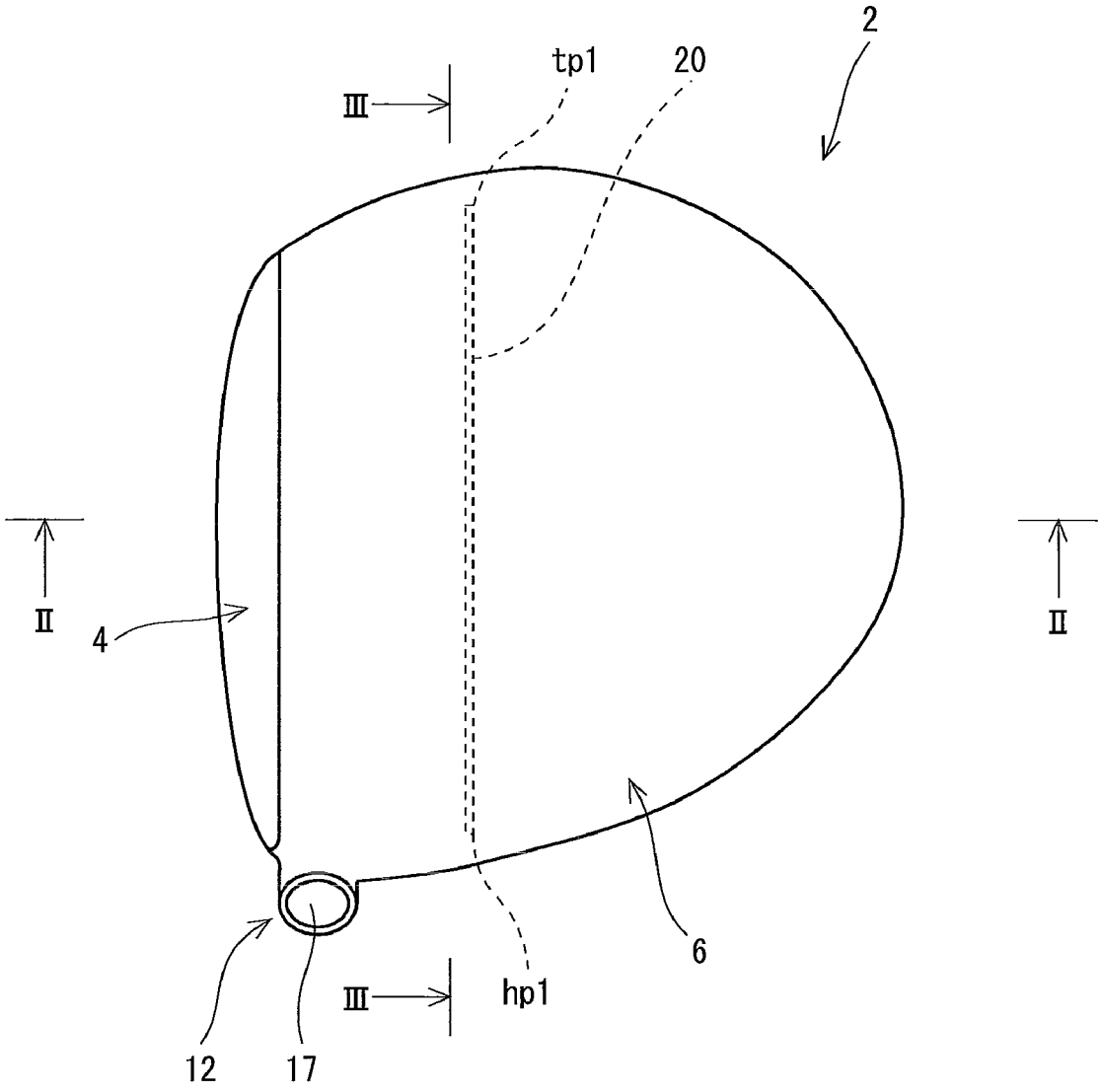
FIG. 1 is a view of a golf club head according to a first embodiment as seen from a crown side.
Figure 2:
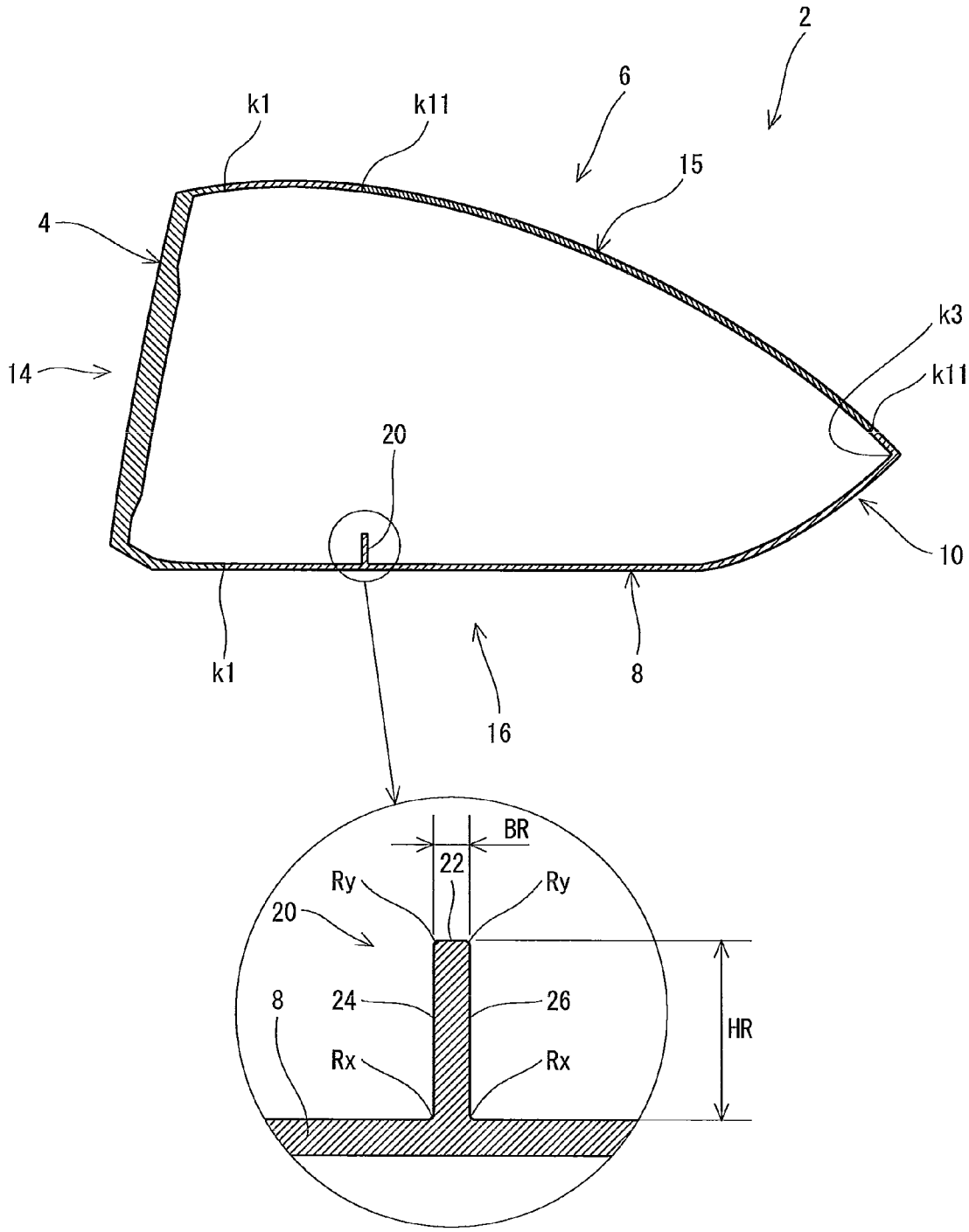
FIG. 2 is a cross sectional view taken along a line II-II in FIG. 1.
Figure 3:
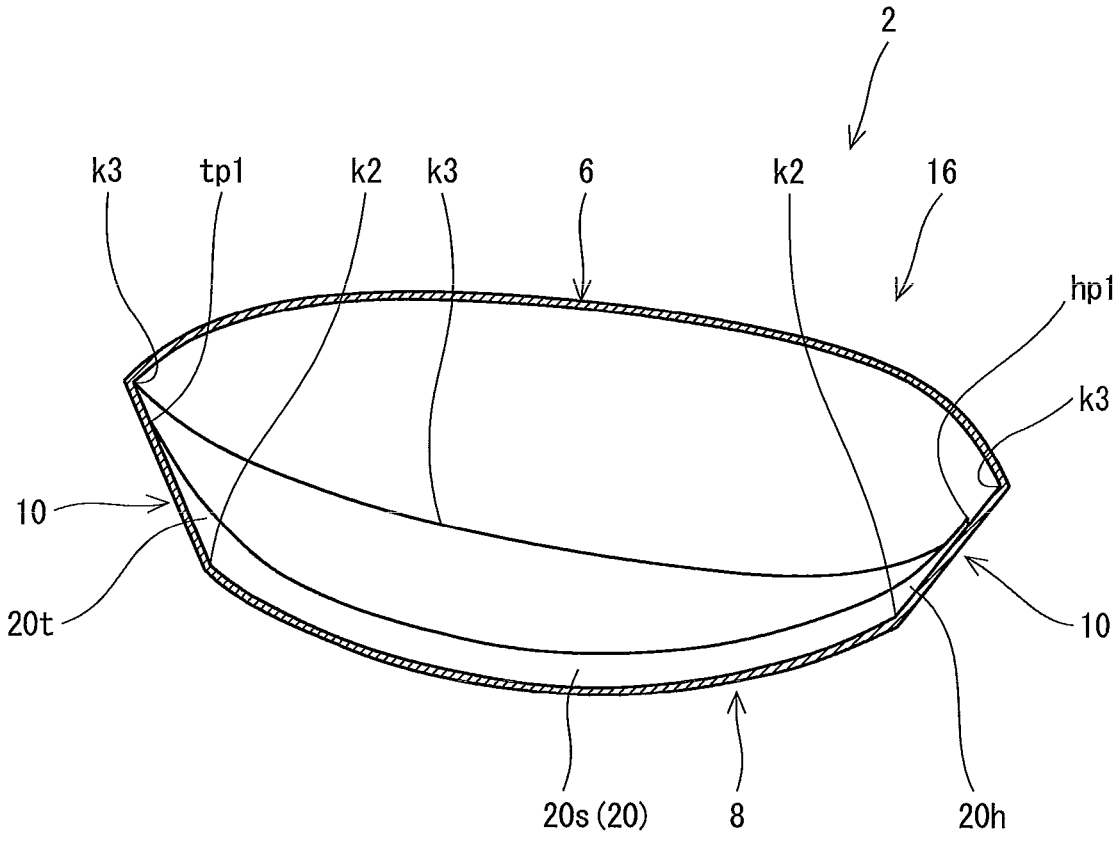
FIG. 3 is a cross sectional view taken along a line III-III in FIG. 1.

As shown in FIGS. 1, 2 and 3, a head 2 has a face 4, a crown 6, a sole 8, a side 10 and a hosel 12. The crown 6 extends toward the back of the head from the upper edge of the face 4. The sole 8 extends toward the back of the head from the lower edge of the face 4. The side 10 extends between the crown 6 and the sole 8. The side 10 extends to a heel side from a toe side via a back side. As shown in FIGS. 2 and 3, the inside of the head 2 is hollow. The head 2 is hollow. The head 2 is a so-called wood type golf club head.

As shown in FIG. 3, a boundary k2 between the sole 8 and the side 10 exists on the inner surface of the head 2. Furthermore, a boundary k3 between the side 10 and the crown 6 exists on the inner surface of the head 2.

The head 2 is constituted by bonding a face member 14, a crown member 15 and a head body 16 (see FIG. 2). A bonding method is welding. All of the face member 14, the crown member 15 and the head body 16 are made of a titanium alloy. A boundary k1 between the face member 14 and the head body 16 is shown in FIG. 2. A boundary k11 between the crown member 15 and the head body 16 is shown in FIG. 2.

The face member 14 constitutes the whole face 4. Furthermore, the face member 14 constitutes a part of the crown 6, a part of the sole 8 and a part of the side 10. The face member 14 is approximately dish-shaped (cup-shaped). The face member 14 may be referred to as a cup face.

The crown member 15 constitutes a part of the crown 6. The crown member 15 constitutes the central part of the crown 6.

The body 16 constitutes a part of the crown 6, a part of the sole 8, a part of the side 10 and the whole hosel 12. The body 16 has a through-hole (not shown) having a shape corresponding to the shape of the crown member 15. The crown member 15 blocks the through-hole.

As shown in FIG. 1, the hosel 12 has a hole 17 to which a shaft is mounted. The shaft (not shown) is inserted into the hole 17. The hole 17 has a center axial line Z1 (not shown). The center axial line Z1 generally conforms to a shaft axial line of a golf club having the head 2.

In the present application, a reference vertical plane, a face-back direction and a toe-heel direction are defined. A reference state denotes a state that the center axial line Z1 is contained in a plane P1 perpendicular to a horizontal plane H and the head is placed on the horizontal plane H at a prescribed lie angle and real loft angle. The reference vertical plane denotes the plane P1.

In the present application, the toe-heel direction is a direction of line of intersection between the reference vertical plane and the horizontal plane H.

In the present application, the face-back direction is a direction perpendicular to the toe-heel direction and parallel to the horizontal plane H.

The head 2 has an inner surface on which a rib 20 is provided. As shown in FIG. 3, the rib 20 continuously extends to the side 10 of the heel side from the side 10 of the toe side via the sole 8. That is, the rib 20 has a sole disposing part 20*s* located on the inner surface of the sole 8, a toe side part 20*t* located on the side 10 of the toe side, and a heel side part 20*h* located on the side 10 of the heel side. The toe side part 20*t* is located on the toe side than the heel side part 20*h*. The toe side part 20*t* is located on the toe side than the sole disposing part 20*s*. The heel side part 20*h* is located on the heel side than the sole disposing part 20*s*.

A toe side end point tp1 of the rib 20 is an end point of the toe side part 20*t*. A heel side end point hp1 of the rib 20 is an end point of the heel side part 20*h*.

The rib 20 is continuously provided without interruption. The rib 20 is continuously provided to the end point hp1 from the end point tp1. The toe side part 20*t*, the sole disposing part 20*s* and the heel side part 20*h* are continuously connected. That is, the toe side part 20*t*, the sole disposing part 20*s* and the heel side part 20*h* are continuously provided.

The number of the ribs 20 is one. The rib 20 extends in the shape of the line. As shown in FIG. 1, the rib 20 extends linearly. When the rib 20 is projected on the horizontal plane H in the head 2 of the reference state, a projection image Tr of the rib 20 is almost straight. The width directional central line (not shown) of the upper surface 22 of the rib 20 is a straight line. The width of the upper surface 22 of the rib 20 is constant. The upper surface 22 of the rib 20 extends straightly. The side 24 of the face side of the rib 20 is a plane. The side 26 of the back side of the rib 20 is a plane.

The sole 8 vibrates at the time of hitting a ball. The vibration of the sole 8 contributes to the hitting sound. The rib 20 enhances the rigidity of the sole 8. The frequency of the hitting sound is raised by the rib 20. The rib 20 contributes to the improvement of the hitting sound.

The side 10 vibrates at the time of hitting the ball. The vibration of the side 10 contributes to the hitting sound. The rib 20 enhances the rigidity of the side 10. The frequency of the hitting sound is raised by the rib 20. The rib 20 contributes to the improvement of the hitting sound.

In the embodiment, the single rib 20 reinforces the sole 8, the side 10 of the heel side and the side 10 of the toe side. It was found that the high improving effect of the hitting sound is attained by the constitution. It is believed that the vibration of the head at the time of hitting the ball includes a vibrating form in which the central part of the sole 8 is an antinode and the side 10 is a node. It is believed that the rib 20 effectively enhances the frequency of the sound caused by the vibrating form. The rib 20 can enhance the frequency of the hitting sound effectively.

Since the single rib 20 reinforces the sole 8, the side 10 of the heel side, and the side 10 of the toe side, the improvement of the hitting sound is attained while the weight of the rib 20 is suppressed.

Figure 4:
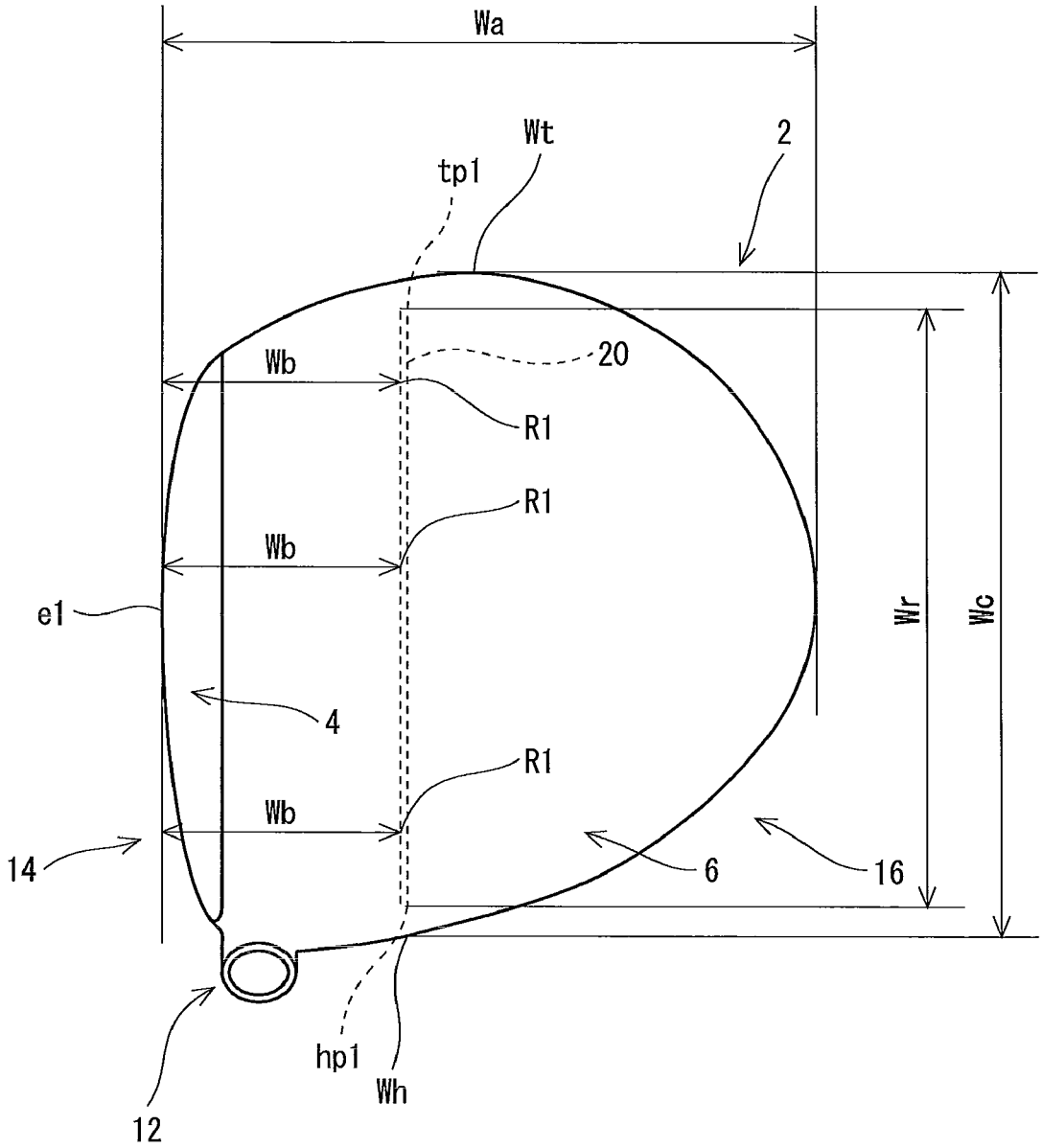
FIG. 4 is a view of a golf club head of a first embodiment as seen from a crown side.

FIG. 4 is a view of the head 2 as seen from a crown side as in FIG. 1. The forefront point of the head is shown by a numeral character e1 in FIG. 4. The forefront point e1 is a point located closest to the face side (front) in the head 2 of the reference state. The forefront point e1 is included in a leading edge.

The width of the head is shown by numeral character Wa in FIG. 4. The width Wa of the head is the maximum width of the head in the face-back direction. The width Wa of the head is measured based on a projection image obtained by projecting the head of the reference state on the horizontal plane H. The projection direction of the projection is a direction perpendicular to the horizontal plane H.

Points belonging to the rib 20 are shown by numeral character R1 in FIG. 4. A large number of points R1 exist.

A face-back direction distance between the forefront point e1 and the point R1 is shown by numeral number Wb in FIG. 4. The distance Wb is determined for each of the points R1 belonging to the rib 20.

The length of the head is shown by numeral number Wc in FIG. 4. The length of the head is a toe-heel direction length between a point Wh on the heel side and a point Wt on the toe side. The point Wt is a point located closest to the toe side in the head of the reference state. On the determination of the point Wh, in the head of the reference state, a horizontal plane H1 separated by 22.23 mm above the horizontal plane H is considered. A point included in the horizontal plane H1, also included in the head and located closest to the heel side is the point Wh. The length Wc of the head is a distance in the toe-heel direction between the point Wt and the point Wh The length of the rib 20 is shown by numeral character Wr in FIG. 4. The length Wr of the rib is measured based on the projection image Tr obtained by projecting the rib 20 on the horizontal plane H in the head 2 of the reference state. The projection direction of the projection is a direction perpendicular to the horizontal plane H. The length Wr of the rib is a length in the toe-heel direction.

When a ratio (Wb/Wa) is too small, the rib 20 is separated from the antinode of the vibration, and the effect of suppressing the vibration is apt to be reduced. In light of suppressing the vibration of the sole 8 and side 10 and of raising the frequency of the hitting sound, the ratio (Wb/Wa) for all the points R1 is preferably equal to or greater than 0.25, and more preferably equal to or greater than 0.29.

When the ratio (Wb/Wa) is too great, the rib 20 is separated from the antinode of the vibration, and the effect of suppressing the vibration is apt to be reduced. In light of suppressing the vibration of the sole 8 and side 10 and of raising the frequency of the hitting sound, the ratio (Wb/Wa) for all the points R1 is preferably equal to or less than 0.50, more preferably equal to or less than 0.46, still more preferably equal to or less than 0.40, and particularly preferably equal to or less than 0.38.

The rib 20 may extend in a curved condition. Even when the rib 20 extends in the curved condition, it is preferable that the ratio (Wb/Wa) for all the points R1 satisfy the preferable range. In light of enhancing a vibration suppressing effect while suppressing the weight of the rib 20, more preferably, the rib 20 extends straightly.

Figure 5:
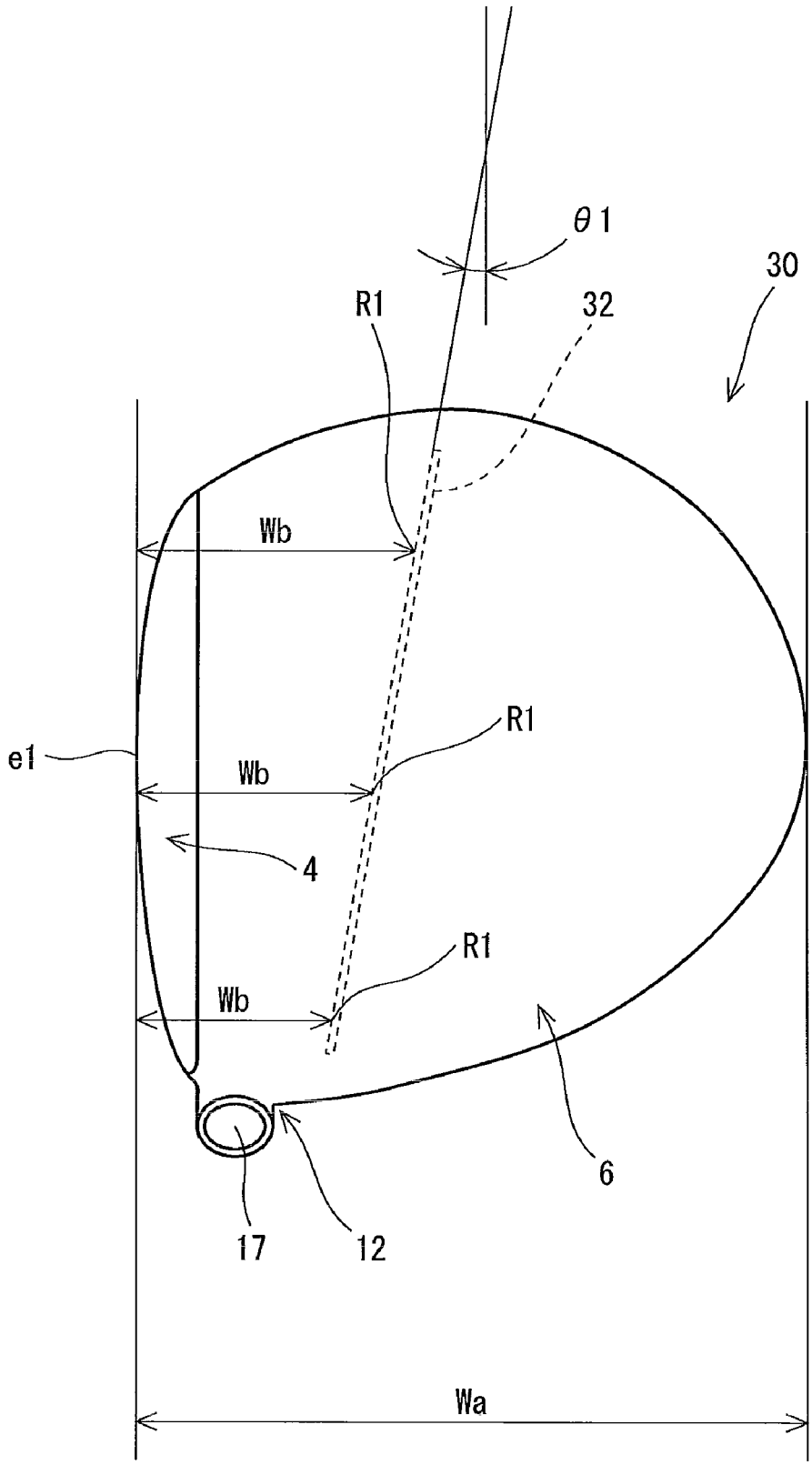
FIG. 5 is a view of a golf club head of a second embodiment as seen from a crown side.

FIG. 5 is a view of a head 30 according to a second embodiment as seen from a crown side.

The head 30 has a face 4, a crown 6, a sole 8, a side 10 and a hosel 12. The crown 6 extends toward the back of the head from the upper edge of the face 4. The sole 8 extends toward the back of the head from the lower edge of the face 4. The side 10 extends between the crown 6 and the sole 8. The side 10 extends to a heel side from a toe side via a back side. The head 30 is hollow. The head 30 is a so-called wood type golf club head.

The head 30 has an inner surface on which a rib 32 is provided. The rib 32 continuously extends to the side 10 of the heel side from the side 10 of the toe side via the sole 8.

The difference between the head 30 and the head 2 is the extending direction of the rib. The extending direction of the rib 32 is inclined relative to a toe-heel direction. In the present invention, such constitution is also possible. In all points R1 of the rib 32, a ratio (Wb/Wa) is 0.25 or greater and 0.50 or less.

Figure 6:
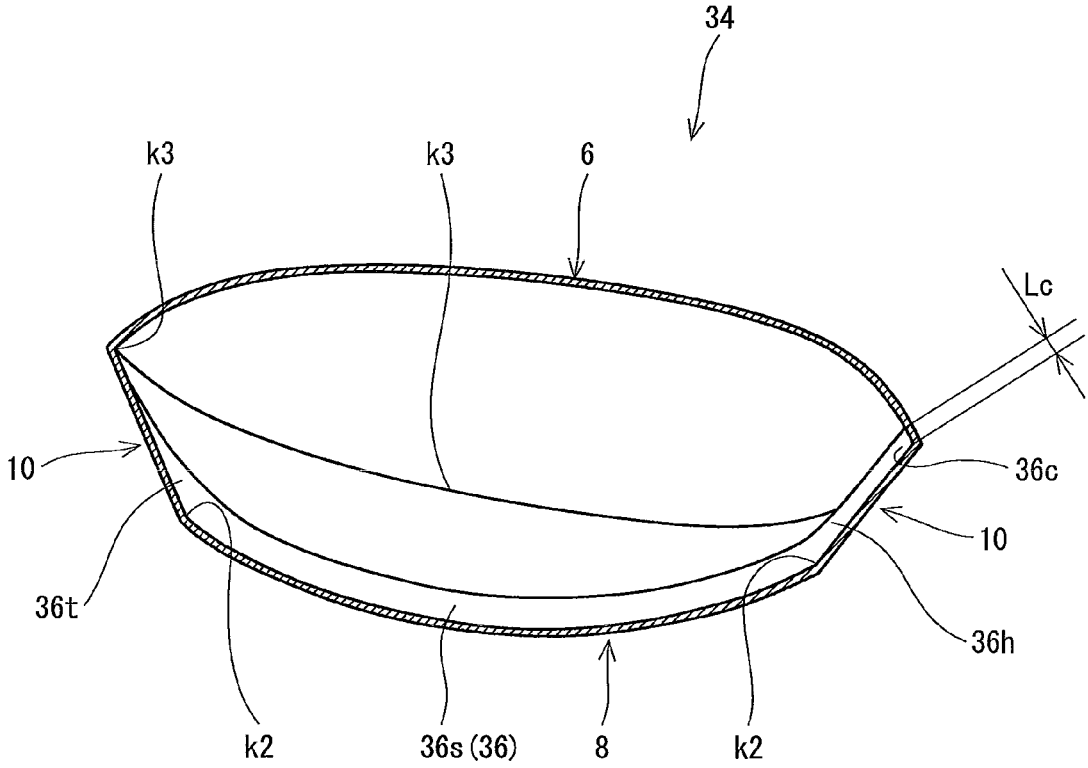
FIG. 6 is a cross sectional view of a golf club head of a third embodiment.

FIG. 6 is a sectional view of a head 34 according to a third embodiment. In the head 34, a rib 36 extends to a crown 6. The rib 36 continuously extends to the crown 6 from a side 10 of a toe side via a sole 8 and a side 10 of a heel side. That is, the rib 36 has a sole disposing part 36*s* located on the inner surface of the sole 8, a toe side part 36*t* located on the side 10 of the toe side, a heel side part 36*h* located on the side 10 of the heel side, and a crown disposing part 36*c* located on the inner surface of the crown 6. The crown disposing part 36*c* is provided on the heel side. The crown disposing part 36*c* is provided on the heel side of the heel side part 36*h*. The head 34 is the same as the head 2 except that the rib extends to the crown 6.

Thus, the rib 36 has a heel side end extending to the crown 6. In the rib 36, the toe side part 36*t*, the sole disposing part 36*s*, the heel side part 36*h* and the crown disposing part 36*c* are continuously provided. In the present invention, such constitution is also possible. In the head 34, the crown disposing part 36*c* is provided on the heel side only. The crown disposing part 36*c* may be provided on the toe side. That is, the toe side end of the rib may extend to the crown 6. The crown disposing part 36*c* may be provided on the toe side and the heel side. That is, the toe and heel side ends of the rib may extend to the crown 6.

At the time of hitting a ball, the crown 6 may be compressed and deformed. A loft angle is increased due to the compressive deformation of the crown 6. When the rib located on the crown 6 is too long, the compressive deformation of the crown 6 may be excessively suppressed to reduce a launch angle. The reduction of the launch angle is apt to decrease a flight distance. When the rib located on the crown 6 is too long, the weight of the head is apt to increase. When the rib located on the crown 6 is too long, the position of center of gravity of the head is apt to be raised. The launch angle is apt to be reduced due to the high position of center of gravity. In this case, the flight distance is apt to be reduced. From these viewpoints, a length Lc of the rib on the crown 6 is preferably equal to or less than 10 mm, more preferably equal to or less than 5 mm, and still more preferably equal to or less than 3 mm. In FIG. 6, the length Lc of the rib 36 on the heel side is shown. The length Lc is a length of the crown disposing part 36*c*. When the crown disposing part 36*c* is provided on the toe side, the rib length Lc of the crown disposing part 36*c* on the toe side is also preferably equal to or less than 10 mm, more preferably equal to or less than 5 mm, and still more preferably equal to or less than 3 mm. In light of eliminating the problem when the rib extends to the crown 6, it is preferable that the toe and heel sides of the rib terminate at the side 10.

On the other hand, in light of the improvement of a hitting sound, it is preferable that the rib extends to the crown 6. That is, in light of the improvement of the hitting sound, it is preferable that the crown disposing part 36*c* is provided. The rib existing on the crown 6 can further raise the frequency of the hitting sound. When the hitting sound is emphasized, it is preferable that at least one of the toe and heel sides of the rib extends to the crown 6. In this case, it is more preferable that the toe side of the rib terminates at the side 10 and the heel side of the rib terminates at the crown 6. That is, the crown disposing part 36*c* is preferably provided on the heel side only. The center of gravity of the head is located closer to the heel by extending only the heel side to the crown 6. The head is likely to be closed at the time of impact by locating the center of gravity of the head closer to the heel, and thereby slice can be suppressed, and hitting directivity can be stabilized.

Cracks may be generated in the rib by repeated hitting. As shown in an enlarged view of FIG. 2, it is preferable that a root Rx of the rib has a roundness having a curvature radius rx. In light of enhancing the durability of the rib, the curvature radius rx is preferably equal to or greater than 0.5 mm, and more preferably equal to or greater than 1.0 mm. In view of suppressing the weight of the rib, the curvature radius rx is preferably equal to or less than 3.0 mm, and more preferably equal to or less than 2.0 mm.

As shown in the enlarged view of FIG. 2, it is preferable that an edge Ry of the upper surface of the rib has a roundness having a curvature radius ry. In light of enhancing the durability of the rib, the curvature radius ry is preferably equal to or greater than 0.2 mm, and more preferably equal to or greater than 0.4 mm. The upper limit of the curvature radius ry is restrained to the width of the rib. More preferably, in the sectional view of FIG. 2, the whole upper surface of the rib may be a curved surface having a constant curvature radius rc.

The preferable value of the curvature radius rc is equal to the preferable value of the curvature radius ry.

The width Wa of the head is not limited. In light of deepening a depth of center of gravity and of increasing a moment of inertia, the width Wa of the head is preferably equal to or greater than 100 mm, more preferably equal to or greater than 107 mm, and still more preferably equal to or greater than 115 mm. In light of observance of the rules for the golf club, the width Wa of the head is preferably equal to or less than 127 mm, and particularly preferably 125 mm when the error of measurement of 2 mm is considered.

The length Wc of the head is not limited. In light of widening the face and of increasing the moment of inertia, the length Wc of the head is preferably equal to or greater than 100 mm, more preferably equal to or greater than 107 mm, and still more preferably equal to or greater than 115 mm. In light of observance of the rules for the golf club, the length Wc of the head is preferably equal to or less than 127 mm, and particularly preferably 125 mm when the error of measurement of 2 mm is considered.

The volume of the head is not limited. In light of the increase of the moment of inertia and of the enlargement of an sweet area, the volume of the head is preferably equal to or greater than 400 cc, more preferably equal to or greater than 420 cc, and still more preferably equal to or greater than 440 cc. In light of observance of the rules for the golf club, the volume of the head is preferably equal to or less than 470 cc, and particularly preferably 460 cc when the error of measurement of 10 cc is considered.

The weight Mh of the head is not limited. In light of swing balance, the weight Mh of the head is preferably equal to or greater than 175 g, more preferably equal to or greater than 180 g, and still more preferably equal to or greater than 185 g. In light of the swing balance, the weight Mh of the head is preferably equal to or less than 205 g, more preferably equal to or less than 200 g, and still more preferably equal to or less than 195 g.

The weight Mr of the rib is not limited. In light of suppressing the vibrations of the sole and side to obtain a high hitting sound, the weight Mr of the rib is preferably equal to or greater than 1.0 g, more preferably equal to or greater than 1.2 g, and still more preferably equal to or greater than 1.5 g. When the weight of the rib is excessive, the weight capable of being distributed to the head body decreases, and the moment of inertia is reduced. From this viewpoint, the weight Mr of the rib is preferably equal to or less than 5.0 g, more preferably equal to or less than 4.0 g, and still more preferably equal to or less than 3.0 g.

A ratio (Mr/Mh) of the weight Mr of the rib to the weight Mh of the head is not limited. In light of obtaining the high hitting sound, the ratio (Mr/Mh) is preferably equal to or greater than 0.008, more preferably equal to or greater than 0.009, and still more preferably equal to or greater than 0.010. When the weight of the rib is excessive, the weight capable of being distributed to the head body decreases, and the moment of inertia is reduced. From this viewpoint, the ratio (Mr/Mh) is preferably equal to or less than 0.025, more preferably equal to or less than 0.020, and still more preferably equal to or less than 0.015.

The height of the rib is shown by a double-pointed arrow HR in an enlarged view of FIG. 2. In light of enhancing the hitting sound, the average value of the height HR of the rib is preferably equal to or greater than 2 mm, more preferably equal to or greater than 2.5 mm, and still more preferably equal to or greater than 3 mm. In light of suppressing the weight of the rib, the average value of the height HR of the rib is preferably equal to or less than 6 mm, and more preferably equal to or less than 5 mm.

In light of enhancing the hitting sound, the maximum value of the height HR of the rib is preferably equal to or greater than 3 mm, more preferably equal to or greater than 3.5 mm, and still more preferably equal to or greater than 4 mm. In light of suppressing the weight of the rib, the maximum value of the height HR of the rib is preferably equal to or less than 10 mm, more preferably equal to or less than 9 mm, and still more preferably equal to or less than 8 mm.

In light of enhancing the hitting sound, the average value of the height HR of the rib on the sole is preferably equal to or greater than 3 mm, more preferably equal to or greater than 3.5 mm, and still more preferably equal to or greater than 4 mm. In light of suppressing the weight of the rib, the average value of the height HR of the rib on the sole is preferably equal to or less than 7 mm, more preferably equal to or less than 6 mm, and still more preferably equal to or less than 5 mm.

In light of suppressing the weight of the rib while suppressing the vibration of the side on the heel side, preferably, the height HR of the rib in the heel side end part of the rib is gradually or stepwisely reduced toward the heel side. In light of suppressing the weight of the rib while suppressing the vibration of the side on the toe side, preferably, the height HR of the rib in the toe side end part of the rib is gradually or stepwisely reduced toward the toe side.

In light of suppressing the weight of the rib while suppressing the vibration of the side, the average value of the height HR of the rib on the side is preferably smaller than the average value of the height HR of the rib on the sole.

The width of the rib is shown by a double-pointed arrow BR in the enlarged view of FIG. 2. In light of enhancing the hitting sound, the average value of the width BR of the rib is preferably equal to or greater than 0.5 mm, more preferably equal to or greater than 0.7 mm, and still more preferably equal to or greater than 0.9 mm. In light of suppressing the weight of the rib, the average value of the width BR of the rib is preferably equal to or less than 1.5 mm, more preferably equal to or less than 1.3 mm, and still more preferably equal to or less than 1.1 mm. The length of a part of the rib having the width BR of 0.5 mm or greater and 1.5 mm or less is preferably 50% or greater of the whole length of the rib, more preferably 80% or greater, and particularly preferably 100%.

The ratio (Wr/Wc) of the length Wr of the rib to the length Wc of the head is not limited. In light of enhancing the effect caused by the rib, the ratio (Wr/Wc) is preferably equal to or greater than 0.80, more preferably equal to or greater than 0.85, and still more preferably equal to or greater than 0.90. It is difficult to set the ratio (Wr/Wc) to 1. From this viewpoint, the ratio (Wr/Wc) is preferably equal to or less than 0.98, and more preferably equal to or less than 0.95.

"A primary natural frequency" obtained by exciting the sole is not limited. The hitting sound is connected with the vibrations of the sole or side. The primary natural frequency correlates with the hitting sound.

When the primary natural frequency is high, the hitting sound in actual hitting also is likely to be raised. From this viewpoint, the primary natural frequency is preferably equal to or greater than 3000 Hz, more preferably equal to or greater than 3400 Hz, and still more preferably equal to or greater than 3500 Hz. When the primary natural frequency is too high, resilience performance may be reduced, and there is limit on the design of the head. From these viewpoints, the primary natural frequency can be also set to 5000 Hz or less, and further 4000 Hz or less. The measuring method of the primary natural frequency is described later.

The number of the ribs is not limited. In light of suppressing the weight of the rib, the number of the ribs leading to the side of the heel side from the side of the toe side via the sole is preferably equal to or less than 2, and particularly preferably 1. In addition to the rib leading to the side of the heel side from the side of the toe side via the sole, the other rib may be provided. The rib leading to the side of the heel side from the side of the toe side via the sole may be connected to the other rib. In light of suppressing the weight of the rib, it is also preferable that a rib other than the rib leading to the side of the heel side from the side of the toe side via the sole is not provided on the sole and the side.

An angle (degree) between the extending direction of the projection image Tr of the rib and the toe-heel direction is shown by a double-pointed arrow θ1 in FIG. 5. When the projection image Tr of the rib is bent, the angle θ1 is an angle between each of tangents of the projection image Tr and the toe-heel direction. In light of suppressing the vibration of the sole to enhance the hitting sound, the absolute value of the angle θ1 is preferably equal to or less than 10 degrees, more preferably equal to or less than 7 degrees, and still more preferably equal to or less than 4 degrees.

The material for the head is not limited. As the material of the head, metal and CFRP (Carbon Fiber Reinforced Plastic) or the like are exemplified. As the metal used for the head, one or more kinds of metals selected from pure titanium, a titanium alloy, stainless steel, maraging steel, an aluminium alloy, a magnesium alloy and a tungsten-nickel alloy are exemplified. SUS630 and SUS304 are exemplified as stainless steel. As the specific example of stainless steel, CUSTOM450 (manufactured by Carpenter Company) is exemplified. As the titanium alloy, 6-4 titanium (Ti-6A1-4V) and Ti-15V-3Cr-3Sn-3A1 or the like are exemplified. When the volume of the head is great, the hitting sound is likely to be increased. The present invention is particularly effective in a head having a great hitting sound. From this viewpoint, the material of the head is preferably the titanium alloy. From this viewpoint, the materials of the sole and side are preferably the titanium alloy.

A method for manufacturing the head is not limited. Usually, a hollow head is manufactured by bonding two or more members. A method for manufacturing the members constituting the head is not limited. As the method, casting, forging and press forming are exemplified.

Examples of the structures of the heads include a two-piece structure in which two members integrally formed respectively are bonded, a three-piece structure in which three members integrally formed respectively are bonded, and a four-piece structure in which four members integrally formed respectively are bonded.

The form of the rib is not limited in the present invention. That is, in the present invention, the shape of the rib and the position of the rib or the like are not limited. The rib affects the vibration of the head. The rib affects the hitting sound. The primary natural frequency is likely to be raised by the rib. A head having the primary natural frequency of equal to or greater than 3000 Hz, further equal to or greater than 3400 Hz, and further equal to or greater than 3500 Hz is likely to be attained by providing the rib. Preferably, the rib is provided on the sole. The vibration of the sole at the time of hitting the ball affects the hitting sound. The rib provided on the sole can contribute to a high hitting sound. The rib provided on the sole contributes to the increase of the primary natural frequency. More preferably, the rib has a toe side part located on the inner surface of the side of the toe side, a sole disposing part located on the inner surface of the sole, and a heel side part located on the side of the heel side. More preferable examples of the ribs are the ribs shown in the first, second and third embodiments.

EXAMPLES

Hereinafter, the effects of the present invention will be clarified by Examples. However, the present invention should not be interpreted in a limited way based on the description of Examples.

First, the evaluation method will be described.

[Primary Natural Frequency]

The primary natural frequency was measured in a state of a single head body. A measuring method is as follows.

(a) An acceleration pickup is attached to a sole (sole outer surface) of a head.
(b) A thread is attached to a neck end face of the head, and the head is hung by the thread.
(c) The sole (sole outer surface) of the head is struck by an impact hammer having a force pickup.
(d) Data of an input exciting force F is obtained from the force pickup of the impact hammer.
(e) Response acceleration A is obtained from the acceleration pickup.
(f) "Moving mass=input exciting force F/response acceleration A" is calculated, and the frequency of the primary local minimum value of the moving mass is defined as "primary natural frequency".

When the attaching position of the acceleration pickup in the item (a) is the position of a node of the primary vibration of the sole, the primary vibration (primary local minimum value) does not appear in the item (f). Therefore, the measurement was performed with the acceleration pickup attached to some positions of the sole, and the position in which the primary vibration (primary local minimum value) appeared was searched. Measurement results in attaching the acceleration pickup to the position in which the primary vibration (primary local minimum value) appeared were adopted. A measuring machine in "an impact hammer method" described in Japanese Patent Application Laid-Open No. 2004-65570 can be used for measuring the primary natural frequency. For example, an adhesive is used for attaching the acceleration pickup to the sole.

[Hitting Sound Sensuous Evaluation]

Twenty golf players, each with 5 to 25 handicap, hit golf balls to evaluate the golf clubs. The evaluation was performed in five stages. Scale when the evaluation of a hitting sound was the highest was defined as five scores. Scale when the evaluation of the hitting sound was the lowest was defined as one score. The average value of twenty golf players' scales is shown in the following Tables 1 and 2.

Example 1

A head having the same structure as that of the head 34 according to the third embodiment described above was produced. A head body thereof was obtained by casting a titanium alloy (Ti-6Al-4V). A face member was obtained by forging a round bar of "SuperTI-X51AF" (trade name) manufactured by NIPPON STEEL CORPORATION. A crown member was obtained by pressing a plate material made of a titanium alloy (Ti-15V-3Cr-3Sn-3Al). The head body and the face member were welded, and the head body and the crown member were welded. The welding was performed by laser welding. The outer surface of the head was ground to obtain the head. The weight of the head was 190 g. The volume of the head was 450 cc. The real loft angle of the head was 10 degrees.

As shown in FIG. 1, a rib was provided in parallel to a toe-heel direction. The minimum value Wb1 of a distance Wb was set to 24.5 mm. The minimum value is a face-back direction distance between a side 24 (see FIG. 3) of the face side of the rib and a forefront point e1. The maximum value Wb3 of the distance Wb was set to 25.5 mm. The maximum value is a face-back direction distance between a side 26 (see FIG. 3) of the back side of the rib and the forefront point e1. A face-back direction distance Wb2 between the width direction center position of the rib and the forefront point e1 was set to 25.0 mm.

As shown in FIG. 6, the heel side end of the rib reached a crown. The toe side end of the rib, which did not reach the crown, terminated at the side. The width BR of the rib was set constant. In addition, the specifications of the rib are shown in the following Table 1.

A shaft and grip of the head were attached to obtain a golf club according to Example 1. The specifications and evaluation results of Example 1 are shown in the following Table 1.

Examples 2 to 8

A head and a golf club of each of Examples were obtained in the same manner as in Example 1 except for the specifications shown in Table 1 or 2. The specifications and evaluation results of Examples 2 to 8 are shown in the following Table 1 or 2.

Comparative Example 1

Figure 7:
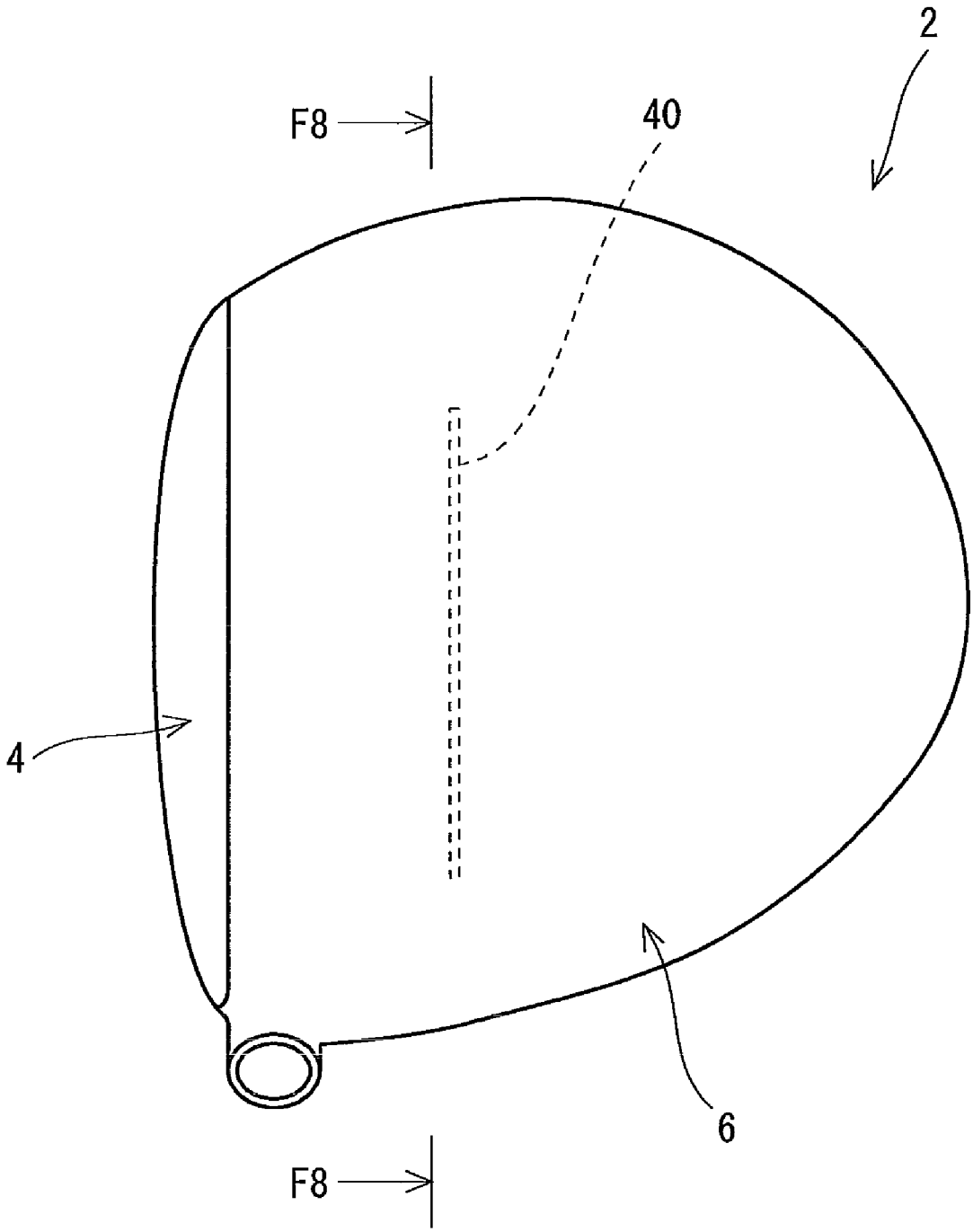
FIG. 7 is a view of a golf club head of Comparative Example 1 as seen from a crown side.
Figure 8:
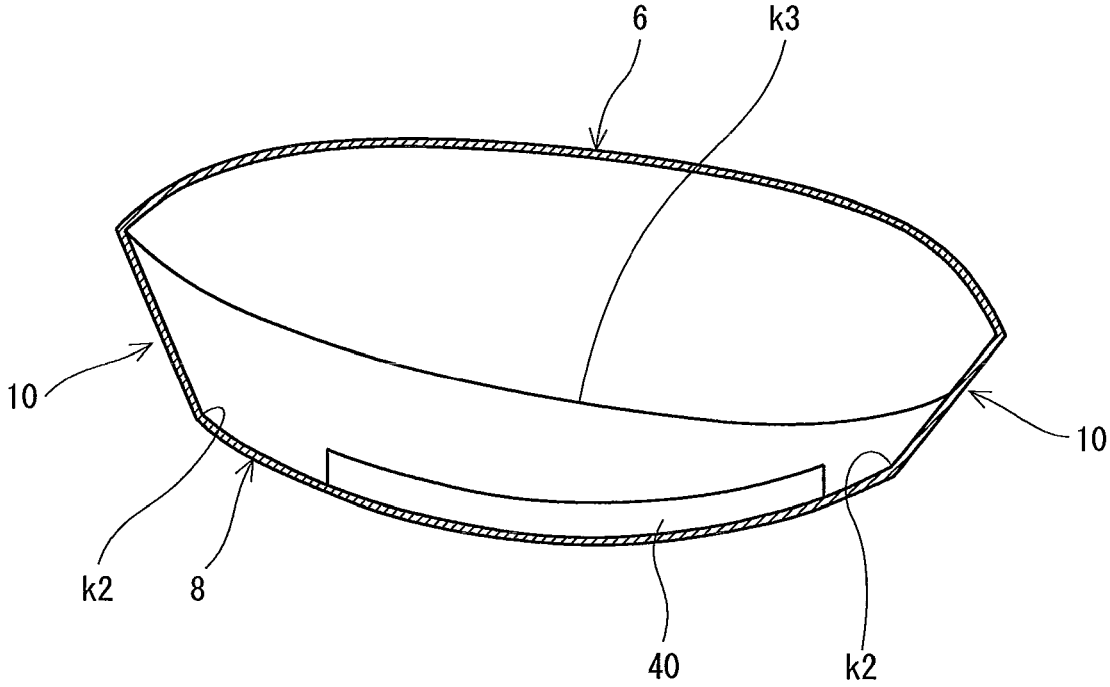
FIG. 8 is a cross sectional view taken along a line F8-F8 in FIG. 7.

A head of Comparative Example 1 is shown in FIGS. 7 and 8. FIG. 8 is a cross sectional view taken along a line F8-F8 in FIG. 7. A rib 40 exists only on the inner surface of a sole 8. The rib 40 does not exist on the inner surface of a crown 6. The rib 40 does not exist on the inner surface of a side 10. A head and a golf club of Comparative Example 1 were obtained in the same manner as in Example 1 except that the length of the rib was shortened. The specifications and evaluation results of Comparative Example 1 are shown in the following Table 2.

Comparative Example 2

A head and a golf club of Comparative Example 2 were obtained in the same manner as in Comparative Example 1 except for the specifications shown in Table 2. The specifications and evaluation results of Comparative Example 2 are shown in the following Table 2.

Comparative Example 3

Figure 9:
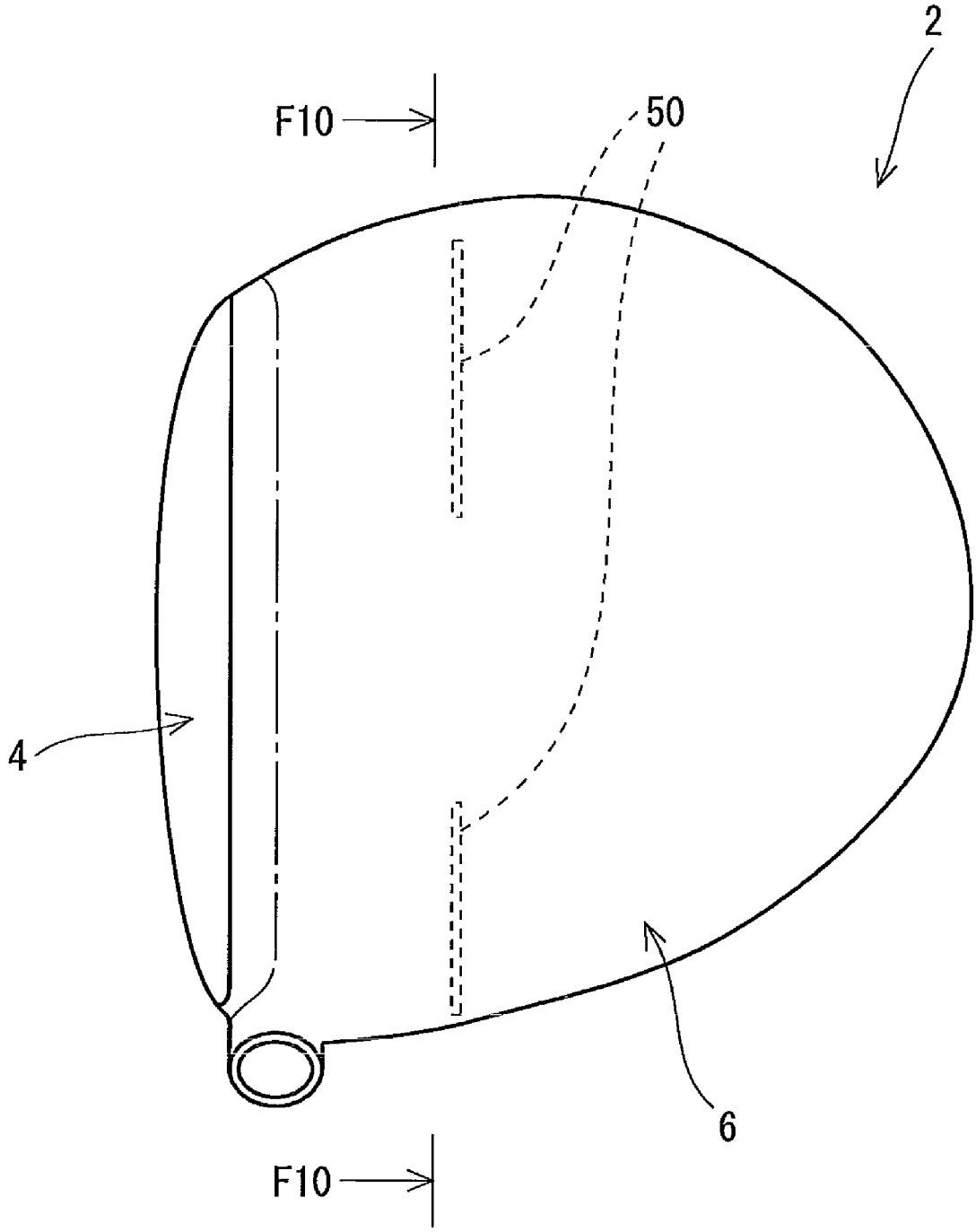
FIG. 9 is a view of a golf club head of Comparative Example 3 as seen from a crown side.
Figure 10:
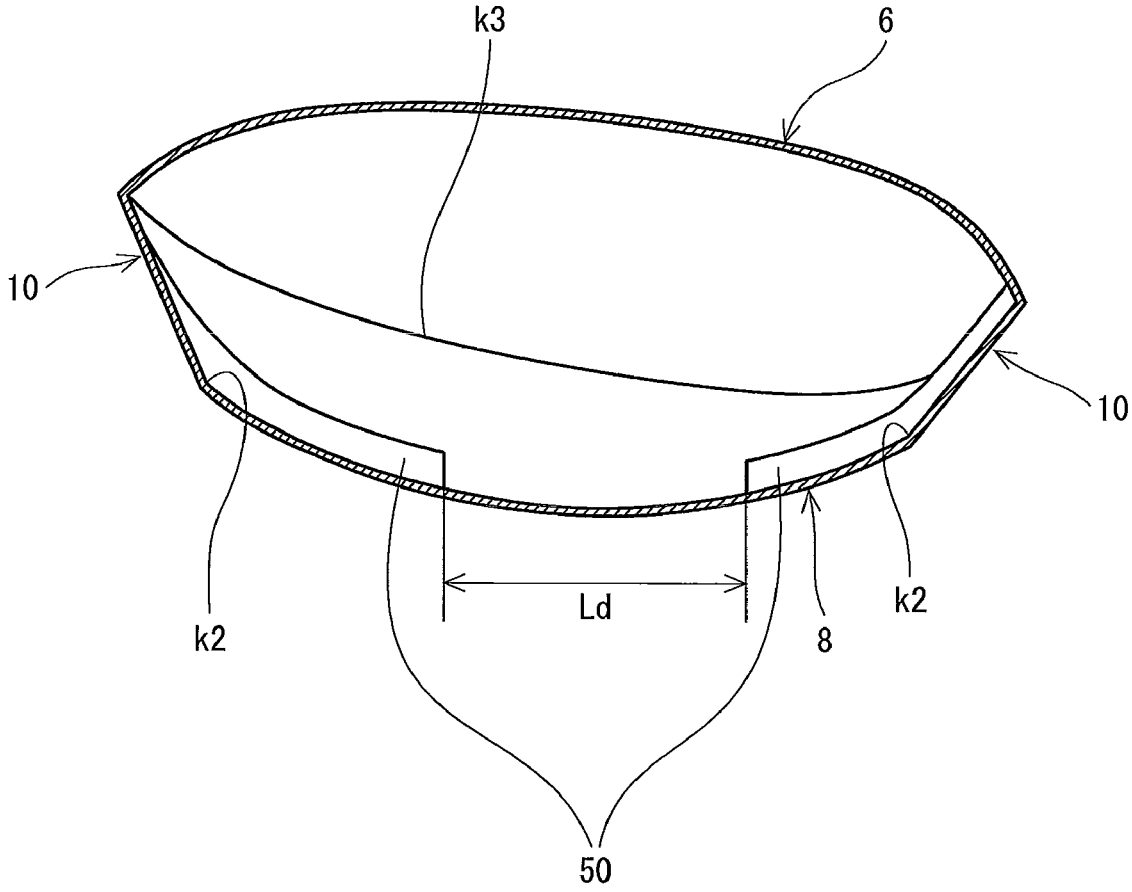
FIG. 10 is a cross sectional view taken along a line F10-F10 in FIG. 9.

A head of Comparative Example 3 is shown in FIGS. 9 and 10. FIG. 10 is a cross sectional view taken along a line F10-F10 in FIG. 9. A rib 50 is divided in the half way. The rib 50 is broken on the inner surface of the sole 8. A discontinuation length Ld (see FIG. 10) of the rib was set to 50 mm. The length Ld was measured along the toe-heel direction. A head and a golf club of Comparative Example 3 were obtained in the same manner as in Example 1 except that an intermediate part of the rib did not exist. The specifications and evaluation results of Comparative Example 3 are shown in the following Table 2.

TABLE 1

Specifications and Evaluation Results of Examples

| | Example 1 | Example 2 | Example 3 | Example 4 | Example 5 |
|---|---|---|---|---|---|
| Views showing the forms of ribs | FIG. 6 | FIG. 6 | FIG. 6 | FIG. 6 | FIG. 6 |
| Width Wa of head (mm) | 121 | 121 | 121 | 121 | 121 |
| Minimum value Wb1 of distance Wb (mm) | 24.5 | 34.5 | 44.5 | 54.5 | 64.5 |
| Distance Wb2 in width direction center position of rib | 25.0 | 35.0 | 45.0 | 55.0 | 65.0 |
| Maximum value Wb3 of distance Wb (mm) | 25.5 | 35.5 | 45.5 | 55.5 | 65.5 |
| Wb1/Wa | 0.20 | 0.29 | 0.37 | 0.45 | 0.53 |
| Wb2/Wa | 0.21 | 0.29 | 0.37 | 0.45 | 0.54 |
| Wb3/Wa | 0.21 | 0.29 | 0.38 | 0.46 | 0.54 |
| Length Wc of head (mm) | 125 | 125 | 125 | 125 | 125 |
| Length Wr of rib (mm) | 115 | 115 | 115 | 115 | 115 |
| Wr/Wc | 0.92 | 0.92 | 0.92 | 0.92 | 0.92 |
| Average value of height HR of rib (mm) | 4 | 4 | 4 | 4 | 4 |
| Average value of height HR of rib in sole part (mm) | 5 | 5 | 5 | 5 | 5 |
| Maximum value of height HR of rib in sole part (mm) | 5 | 5 | 5 | 5 | 5 |
| Minimum value of height HR of rib in sole part (mm) | 5 | 5 | 5 | 5 | 5 |
| Average value of height HR of rib in toe side part (mm) | 3 | 3 | 3 | 3 | 3 |
| Maximum value of height HR of rib in toe side part (mm) | 5 | 5 | 5 | 5 | 5 |
| Minimum value of height HR of rib in toe side part (mm) | 1 | 1 | 1 | 1 | 1 |
| Average value of height HR of rib in heel side part (mm) | 4 | 4 | 4 | 4 | 4 |
| Maximum value of height HR of rib in heel side part (mm) | 5 | 5 | 5 | 5 | 5 |
| Minimum value of hieight HR of rib in heel side part (mm) | 3 | 3 | 3 | 3 | 3 |
| Length Lc of rib disposed on toe side of crown (mm) | 0 | 0 | 0 | 0 | 0 |
| Length Lc of rib disposed on heel side of crown (mm) | 3 | 3 | 3 | 3 | 3 |
| Discontinuation length Ld of rib (mm) | — | — | — | — | — |
| Weight Mr of rib (g) | 2 | 2 | 2 | 2 | 2 |
| Weight Mh of head (g) | 190 | 190 | 190 | 190 | 190 |
| Mr/Mh | 0.011 | 0.011 | 0.011 | 0.011 | 0.011 |
| Primary natural frequency | 3150 | 3500 | 3650 | 3400 | 3200 |
| Hitting sound sensuous evaluation | 4.1 | 4.4 | 4.8 | 4.2 | 4.0 |
| Curvature radius rx of root of rib (mm) | 1.5 | 1.5 | 1.5 | 1.5 | 1.5 |
| Curvature radius ry of upper surface of rib (mm) | 0.3 | 0.3 | 0.3 | 0.3 | 0.3 |
| Width BR of rib (mm) | 1 | 1 | 1 | 1 | 1 |

TABLE 2

Specifications and Evaluation Results of Examples and Comparative Examples

| | Comparative Example 1 | Comparative Example 2 | Comparative Example 3 | Example 6 | Example 7 | Example 8 |
|---|---|---|---|---|---|---|
| Views showing the forms of ribs | FIG. 8 | FIG. 8 | FIG. 10 | FIG. 6 | FIG. 6 | FIG. 6 |
| Width Wa of head (mm) | 121 | 121 | 121 | 121 | 121 | 121 |
| Minimum value Wb1 of distance Wb (mm) | 44.5 | 44.5 | 44.5 | 44.5 | 44.5 | 44.5 |
| Distance Wb2 in width direction center position of rib | 45.0 | 45.0 | 45.0 | 45.0 | 45.0 | 45.0 |
| Maximum value Wb3 of distance Wb (mm) | 45.5 | 45.5 | 45.5 | 45.5 | 45.5 | 45.5 |
| Wb1/Wa | 0.37 | 0.37 | 0.37 | 0.37 | 0.37 | 0.37 |
| Wb2/Wa | 0.37 | 0.37 | 0.37 | 0.37 | 0.37 | 0.37 |
| Wb3/Wa | 0.38 | 0.38 | 0.38 | 0.38 | 0.38 | 0.38 |
| Length Wc of head (mm) | 125 | 125 | 125 | 125 | 125 | 125 |
| Length Wr of rib (mm) | 60 | 60 | 65 | 115 | 115 | 115 |
| Wr/Wc | 0.48 | 0.48 | 0.52 | 0.92 | 0.92 | 0.92 |
| Average value of height HR of rib (mm) | 5 | 10 | 4 | 3 | 6 | 8 |
| Average value of height HR of rib in sole part (mm) | 5 | 10 | 5 | 3 | 7 | 10 |
| Maximum value of height HR of rib in sole part (mm) | 5 | 10 | 5 | 3 | 7 | 10 |
| Minimum value of height HR of rib in sole part (mm) | 5 | 10 | 5 | 3 | 7 | 10 |
| Average value of height HR of rib in toe side part (mm) | N/A | N/A | 3 | 2 | 4 | 6 |
| Maximum value of height HR of rib in toe side part (mm) | N/A | N/A | 5 | 3 | 7 | 10 |
| Minimum value of height HR of rib in toe side part (mm) | N/A | N/A | 1 | 1 | 1 | 1 |
| Average value of height HR of rib in heel side part (mm) | N/A | N/A | 4 | 3 | 5 | 7 |
| Maximum value of height HR of rib in heel side part (mm) | N/A | N/A | 5 | 3 | 7 | 10 |
| Minimum value of height HR of rib in heel side part (mm) | N/A | N/A | 3 | 3 | 3 | 3 |
| Length Lc of rib disposed on toe side of crown (mm) | N/A | N/A | 0 | 0 | 0 | 0 |
| Length Lc of rib disposed on heel side of crown (mm) | N/A | N/A | 3 | 3 | 3 | 3 |
| Discontinuation length Ld of rib (mm) | — | — | 50 | — | — | — |
| Weight Mr of rib (g) | 1.2 | 2.4 | 1 | 1.2 | 2.8 | 4 |
| Weight Mh of head (g) | 189.2 | 190.4 | 189 | 189.2 | 190.8 | 192 |
| Mr/Mh | 0.006 | 0.013 | 0.005 | 0.006 | 0.015 | 0.021 |
| Primary natural frequency | 2700 | 2800 | 2800 | 2900 | 3680 | 3700 |
| Hitting sound sensuous evaluation | 3.1 | 3.3 | 3.4 | 3.5 | 4.8 | 4.8 |
| Curvature radius rx of root of rib (mm) | 1.5 | 1.5 | 1.5 | 1.5 | 1.5 | 1.5 |
| Curvature radius ry of upper surface of rib (mm) | 0.3 | 0.3 | 0.3 | 0.3 | 0.3 | 0.3 |
| Width BR of rib (mm) | 1 | 1 | 1 | 1 | 1 | 1 |

As shown in Tables 1 and 2, Examples have higher evaluation than those of Comparative Examples. Advantages of the present invention are clearly indicated by these results of evaluation.

The present invention is applicable to all types of golf clubs such as wood type heads and utility type (hybrid type) heads or the like.

The description hereinabove is merely for an illustrative example, and various modifications can be made in the scope not to depart from the principles of the present invention.

What is claimed is:

1. A hollow golf club head comprising:

a face;

a sole;

a crown; and a side extending between the crown and the sole, wherein the golf club head has an inner surface on which a rib is provided;

the rib has a toe side part located on an inner surface of a side of a toe side, a sole disposing part located on an inner surface of the sole, and a heel side part located on a side of a heel side;

the toe side part, the sole disposing part and the heel side part are continuously provided;

an edge of an upper surface of the rib has a roundness having a curvature radius ry; and the curvature radius ry is equal to or greater than 0.2 mm.

2. The golf club head according to claim 1, wherein a ratio (Wb/Wa) of a face-back direction distance Wb (mm) between a forefront point of the head and a point R1 belonging to the rib to a width Wa (mm) of the head is 0.25 or greater and 0.50 or less in all the points R1.

3. The golf club head according to claim 1, wherein an average height of the rib is 2 mm or greater and 6 mm or less; and an average width of the rib is 0.5 mm or greater and 1.5 mm or less.

4. The golf club head according to claim 1, wherein a ratio (Wr/Wc) of a length Wr (mm) of the rib to a length We (mm) of the head is equal to or greater than 0.80.

5. The golf club head according to claim 1, wherein the rib has further a crown disposing part located on the inner surface of the crown; and the crown disposing part is provided on a heel side and/or a toe side of the rib.

6. The golf club head according to claim 5, wherein a rib length Lc of the crown disposing part on the heel side is equal to or less than 10 mm; and the rib length Lc of the crown disposing part on the toe side is equal to or less than 10 mM.

7. The golf club head according to claim 5, wherein the toe side of the rib terminates at the side, and the heel side of the rib terminates at the crown.

8. The golf club head according to claim 1, wherein a root of the rib has a roundness having a curvature radius rx; and the curvature radius rx is 0.5 mm or greater and 3.0 mm or less.

9. The golf club head according to claim 1, wherein a width Wa of the head is 100 mm or greater and 127 mm or less.

10. The golf club head according to claim 1, wherein a length Wc of the head is 100 mm or greater and 127 mm or less.

11. The golf club head according to claim 1, wherein a volume of the head is 400 cc or greater and 470 cc or less.

12. The golf club head according to claim 1, wherein a weight Mh of the head is 175 g or greater and 205 g or less.

13. The golf club head according to claim 1, wherein a weight Mr of the rib is 1.0 g or greater and 5.0 g or less.

14. The golf club head according to claim 1, wherein a ratio (Mr/Mh) of the weight Mr of the rib to the weight Mh of the head is 0.008 or greater and 0.025 or less.

15. The golf club head according to claim 1, wherein a maximum value of a rib height HR of the rib is 3 mm or greater and 10 mm or less.

16. The golf club head according to claim 1, wherein a primary natural frequency obtained by exciting the sole is 3000 Hz or greater and 5000 Hz or less.

17. The golf club head according to claim 1, wherein the number of the ribs is equal to or less than 2.

18. A hollow golf club head comprising:

a face;

a sole;

a crown; and a side extending between the crown and the sole, wherein the golf club head has an inner surface on which a rib is provided;

the rib has a toe side part located on an inner surface of a side of a toe side, a sole disposing part located on an inner surface of the sole, and a heel side part located on a side of a heel side;

the toe side part, the sole disposing part and the heel side part are continuously provided;

a root of the rib has a roundness having a curvature radius rx; and the curvature radius rx is 0.5 mm or greater and 3.0 mm or less.

* * * * *